US007928949B2

(12) United States Patent
Kim et al.

(10) Patent No.: US 7,928,949 B2
(45) Date of Patent: Apr. 19, 2011

(54) FLEXIBLE CONTROL OF CHARGE SHARE IN DISPLAY PANEL

(75) Inventors: Kyung-Wol Kim, Seoul (KR); Yong-Weon Jeon, Suwon-si (KR); Jong-Hoon Hong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 898 days.

(21) Appl. No.: 11/274,605

(22) Filed: Nov. 15, 2005

(65) Prior Publication Data

US 2006/0164375 A1 Jul. 27, 2006

(30) Foreign Application Priority Data

Nov. 15, 2004 (KR) ..... 10-2004-0092990

(51) Int. Cl.
*G09G 3/36* (2006.01)
*G09G 5/00* (2006.01)

(52) U.S. Cl. ..... 345/98; 345/204

(58) Field of Classification Search ..... 345/98–100
See application file for complete search history.

(56) References Cited

U.S. PATENT DOCUMENTS 5,856,816 A 1/1999 Youn ..... 345/98
7,369,187 B2 * 5/2008 Park ..... 349/38
2004/0263466 A1 * 12/2004 Song et al. ..... 345/100

OTHER PUBLICATIONS

U.S. Patent Application No. US 2002/0075222 to Miyatake, having Publication date of Jun. 20, 2002.
Korean Patent Application No. 1020010089132 to Jung, having Publication date of Jul. 7, 2003 (w/ English Abstract page).

* cited by examiner

*Primary Examiner* — Kevin M Nguyen
(74) *Attorney, Agent, or Firm* — Monica H. Choi

(57) ABSTRACT

A source driver of a display panel includes a channel state signal generator, first switches, and second switches. The channel state signal generator generates first and second channel state signals that are each activated for a respective time period depending on adjustable state length data. The first switches are opened for uncoupling channel output signals from source lines of the display panel when the first channel state signal is activated. The second switches are closed for coupling together the source lines of the display panel for charge sharing when the second channel state signal is activated.

20 Claims, 6 Drawing Sheets

FLEXIBLE CONTROL OF CHARGE SHARE IN DISPLAY PANEL

BACKGROUND OF THE INVENTION

This application claims priority to Korean Patent Application No. 2004-92990, filed on Nov. 15, 2004, in the Korean Intellectual Property Office, the disclosure of which is incorporated herein in its entirety by reference.

1. Field of the Invention

The present invention relates generally to display panels, and more particularly, to a source driver with flexible control of a time period for charge share between source lines in a display panel such as for a flat panel display (FPD) device.

2. Description of the Related Art

Flat panel displays (FPDs) include TFT-LCDs (Thin Film Transistor-Liquid Crystal Displays), EL (Electro Luminance) displays, STN-LCDs (Super Twisted Nematic-Liquid Crystal Displays), PDPs (Plasma Display Panels), etc.

Hereinafter, a TFT-LCD, which is the most widely used display, is described. FIG. 1 is a block diagram of a TFT-LCD 100 including a general TFT-LCD panel 110 and peripheral circuits. The TFT-LCD panel 110 includes an upper plate and a lower plate, each including a plurality of electrodes for generating an electric field. A liquid crystal layer is disposed between the upper and lower plates, each having a respective polarization plate for polarizing light.

In the TFT-LCD 100, the brightness of light transmitted through a liquid crystal of each pixel in the panel 110 is controlled by varying a gray voltage applied to each pixel. In order to apply gray voltages to the pixel electrodes, a plurality of switching devices such as TFTs (thin film transistors) are coupled to the pixel electrodes and are disposed on the lower plate of the TFT-LCD panel 110. Each pixel is for emitting light of R (Red), G (Green), or B (Blue) color in an array for displaying images on the LCD panel.

The TFT-LCD 100 includes gate drivers 120 for driving a plurality of gate lines arranged horizontally in the LCD panel 110. The TFT-LCD 100 also includes source drivers 130 for driving a plurality of source lines arranged vertically in the LCD panel 110. The gate drivers 120 and the source drivers 130 are controlled by a controller (not shown). Generally, such a controller is located outside the LCD panel 110. However, the gate drivers 120 and the source drivers 130 may be located on the LCD panel 110 in a COG (Chip On Glass) type TFT-LCD.

FIG. 2 is a block diagram of a conventional source driver 200. Referring to FIG. 2, the conventional source driver 200 includes a driving circuit unit 210 and a channel switching unit 220. The driving circuit unit 210 receives R, G, and B image data of n bits (n=6, 8, 10, or . . . ) and decodes the received image data to generate gray voltages to be output to corresponding channels. The generated gray voltages are output to corresponding source lines through the channel switching unit 220 as image signals.

The image signals output to the corresponding source lines through output channels S1, S2, S3, . . . of the channel switching unit 220 rapidly charge pixels of the LCD panel 110. Liquid crystal molecules of a pixel receiving one of the image signals are rearranged in proportion to the gray voltage of the image signal, thus controlling the brightness of light transmitted by that pixel. The image data is data obtained by processing digital data of a three-color signal (that is, R,G, or B) transmitted from a graphics card, etc. in the controller according to the resolution of the LCD panel 110.

FIG. 3 is a timing diagram of signals such as the channel output signals S1, S2, S3, . . . and a load control signal LOAD during operation of the source driver of FIG. 2. Referring to FIG. 3, the driving circuit unit 210 latches image data under the control of a data input/output control signal DIO and decodes the latched data. That is, after the data input/output control signal DIO transits from a logic low state to a logic high state, the driving circuit unit 210 latches and decodes image data. At this time, a system clock signal CLK is used as a reference synchronization signal.

A period during which the data input/output control signal DIO is in the logic low state after being in the logic high state may be included in a blanking period during which a load control signal LOAD may be activated to the logic high state. If the load control signal LOAD is thus activated, the channel switching unit 220 causes the output channels S1, S2, S3, . . . to enter a high impedance state (Hi-Z) and an interchannel charge-share state, thereby preventing the gray voltages generated by the driving circuit unit 210 from being transferred to the source lines. That is, the channel switching unit 220 transfers gray voltages (Y(n−1), Y(n), . . . ) generated by the driving circuit unit 210 to the source lines through the output channels S1, S2, S3, . . . only while the load control signal LOAD is deactivated to the logic low state.

In order to cause the output channels S1, S2, S3, . . . to enter the Hi-z state and the charge-share state for precharging the pixels, the load control signal LOAD is activated to the logic high state during each horizontal scan period, as shown in FIG. 3. However, conventionally, the output channels S1, S2, S3, . . . are in such a Hi-z state during the entire activated period of the load control signal LOAD, which may not be suitable for large, high-resolution LCD panels. For example, since a horizontal scan period is short for high resolution and accordingly the number of clock cycles during a blanking period, etc. is limited, a timing margin is deteriorated.

To solve this problem, the activated period of the load control signal LOAD may be reduced. However, such reduction has limitations since performing a precharge operation within such a short time period may be difficult.

SUMMARY OF THE INVENTION

Thus, source drivers in embodiments of the present invention provide flexibility of the time period for charge sharing among source lines in a display panel.

In one embodiment of the present invention, a source driver of a display panel includes a channel state signal generator and a plurality of first switches. The channel state signal generator generates a first channel state signal that is at a first logic state for a time period depending on an adjustable state length data. The first switches are opened for uncoupling channel output signals from source lines of the display panel when the first channel state signal is at the first logic state.

In another embodiment of the present invention, the channel state signal generator generates a second channel state signal that is at a second logic state within the time period when the first channel state signal is at the first logic state. In addition, the source driver includes a plurality of second switches that are closed for coupling together the source lines of the display panel for charge sharing when the second channel state signal is at the second logic state.

In a further embodiment of the present invention, the second switches are not closed simultaneously with the first switches being closed.

In an example embodiment of the present invention, the channel state signal generator includes a register, a counter, a comparator, and an output unit. The register stores the state length data, and the counter counts a number of cycles of a clock signal from when a load signal is activated. The comparator activates a reset signal when the state length data and the counted number of cycles of the clock signal are substantially equal. The output unit generates the second channel state signal that is set to the second logic state after the counter begins counting the number of cycles of the clock signal and until an end of activating the reset signal. In addition, the output unit generates the first channel state signal that is set to the first logic state after the load signal is activated and until after the end of activating the reset signal.

In a further embodiment of the present invention, the state length data is provided to the source driver from an external device independent of the load signal.

In another embodiment of the present invention, the source driver includes a plurality of driving circuits for generating the channel output signals from color image data for the display panel. The state length data is input as part of at least one color image data during a time when the color image data is not latched by the driving circuits.

The source driver of embodiments of the present invention may be used to particular advantage when the display panel is for a large, high-resolution TFT-LCD (Thin Film Transistor-Liquid Crystal Display). However, the source driver of embodiments of the present invention may be also used for driving source lines of other types of display devices.

In this manner, the time period for charge sharing between the source lines is controlled independently of the load signal of the display device. The time period for such charge sharing is flexibly controlled by adjusting the state length data that may be externally provided by a user to the source driver.

BRIEF DESCRIPTION OF THE DRAWINGS

The above and other features and advantages of the present invention will become more apparent when described in detailed exemplary embodiments thereof with reference to the attached drawings in which.

The figures referred to herein are drawn for clarity of illustration and are not necessarily drawn to scale. Elements having the same reference number in FIGS. 1, 2, 3, 4, 5, 6, and 7 refer to elements having similar structure and/or function.

DETAILED DESCRIPTION OF THE INVENTION

Figure 1:
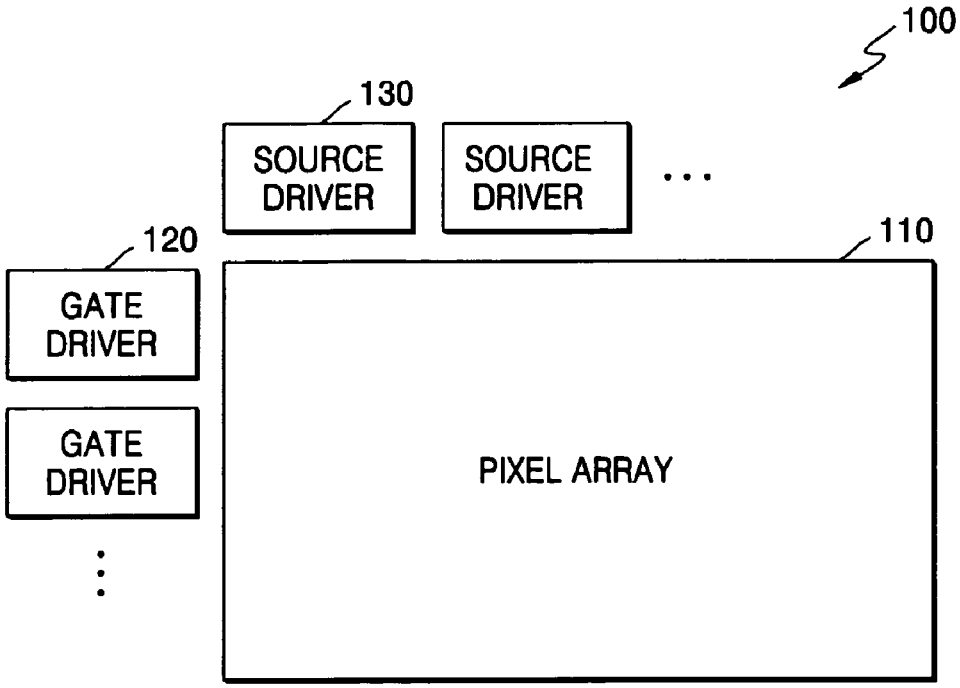
FIG. 1 (PRIOR ART)
FIG. 1 is a block diagram of a general TFT-LCD including a TFT-LCD panel and peripheral circuits, according to the prior art.
Figure 2:
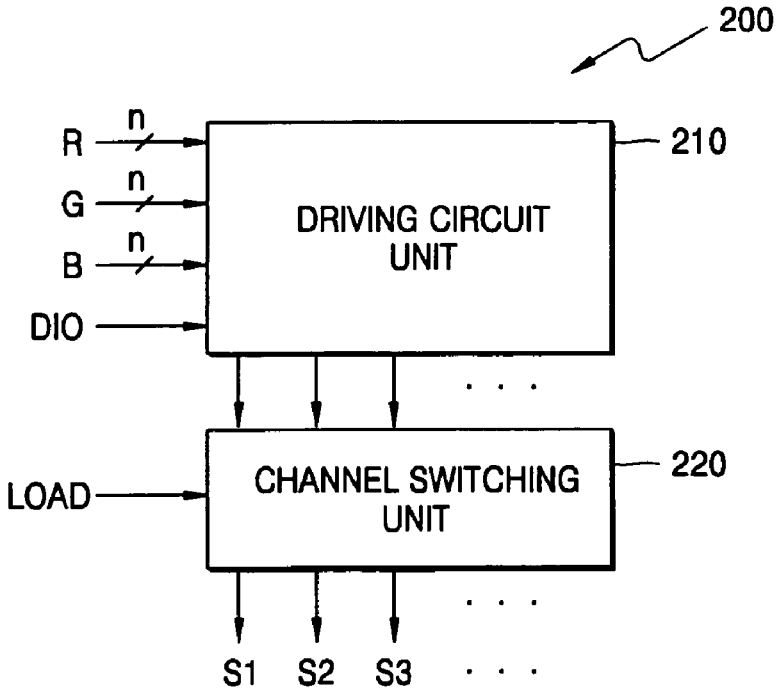
FIG. 2 (PRIOR ART)
FIG. 2 is a block diagram of a conventional source driver.
Figure 3:
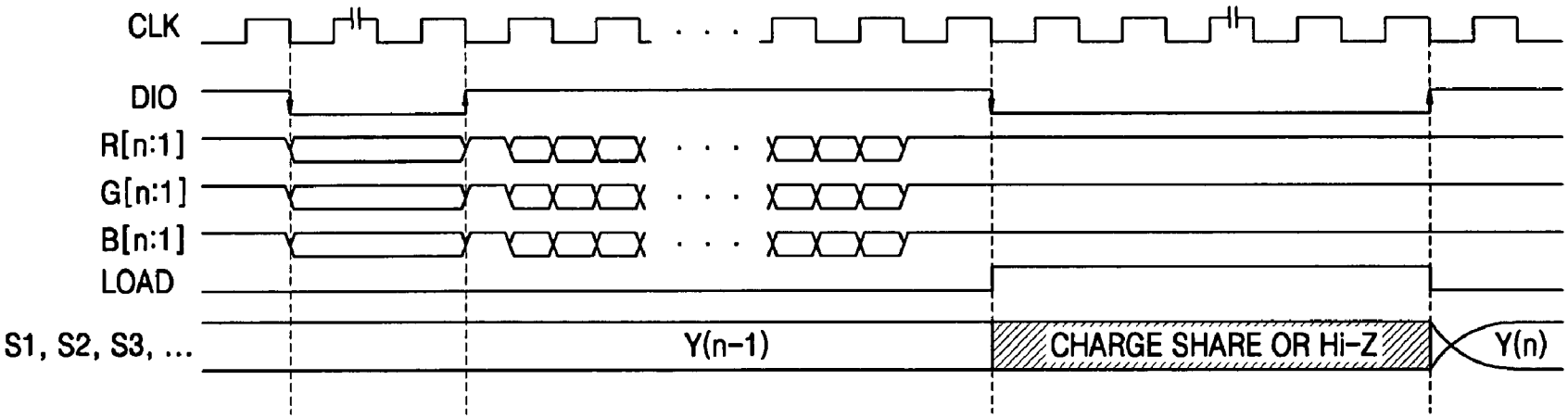
FIG. 3 (PRIOR ART)
FIG. 3 is a timing diagram of signals such as channel output signals and a load control signal LOAD during operation of the source driver of FIG. 2, according to the prior art.
Figure 4:
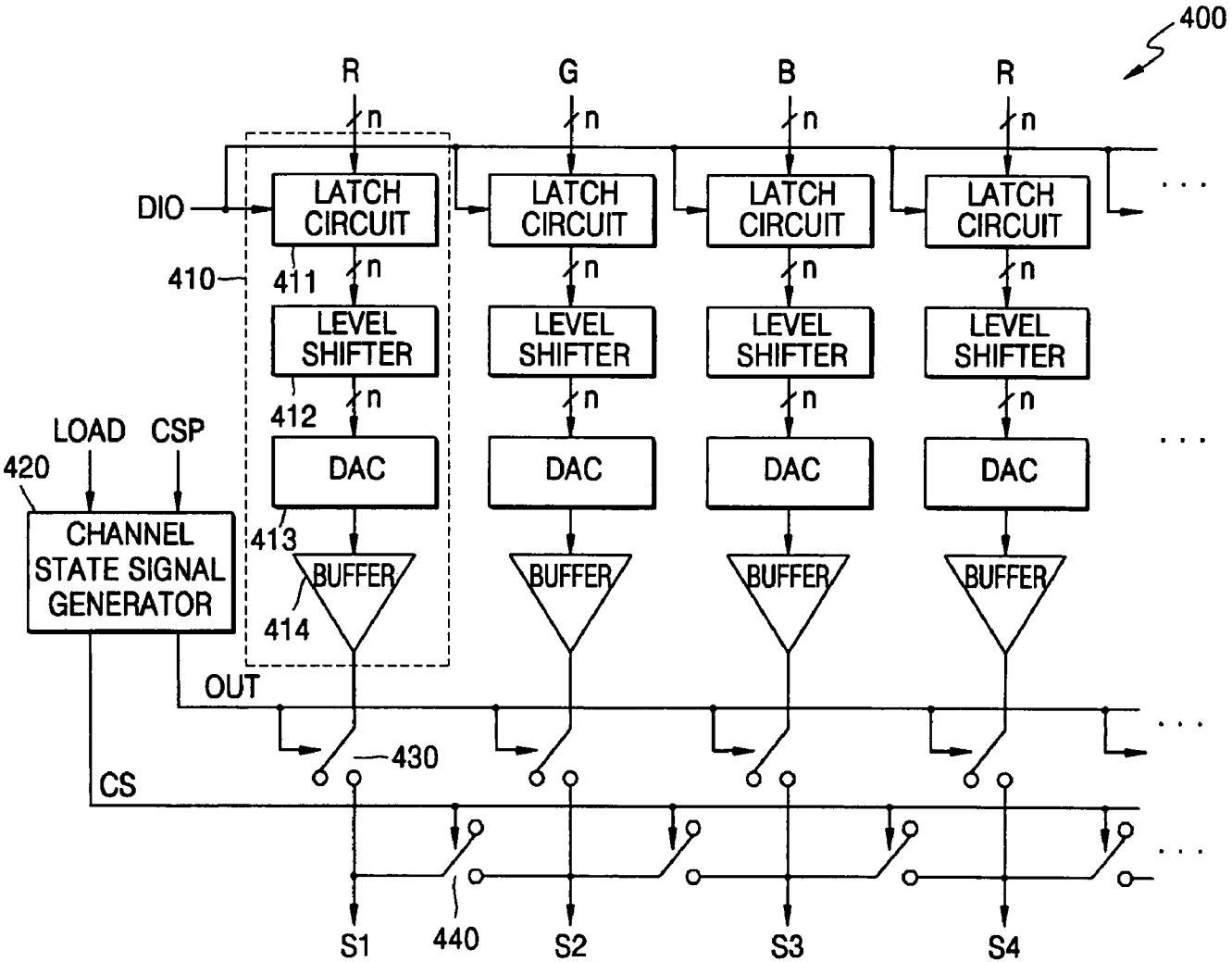
FIG. 4 is a block diagram of a source driver according to an embodiment of the present invention.

FIG. 4 is a block diagram of a source driver 400 according to an embodiment of the present invention. The source driver 400 includes a plurality of driving circuits 410, each corresponding to a respective one of a plurality of output channels S1, S2, S3, . . . . The source driver 400 also includes a channel state signal generator 420, a plurality of first switches 430, and a plurality of second switches 440. The present invention may be practiced with or without the plurality of second switches 440.

FIG. 4 is now described with reference to a timing diagram of FIG. 5. Each of the driving circuit 410 receives a respective n bits of input RGB image data (n=6, 8, 10, or . . . ), and decodes the received image data to generate a respective analog gray voltage to be output to a corresponding channel. To this end, each of the driving circuits 410 includes a latch circuit 411, a level shifter 412, a digital-to-analog converter (DAC) 413, and a buffer 414. The latch circuit 411 latches corresponding image data in response to a data input/output control signal DIO.

Figure 5:
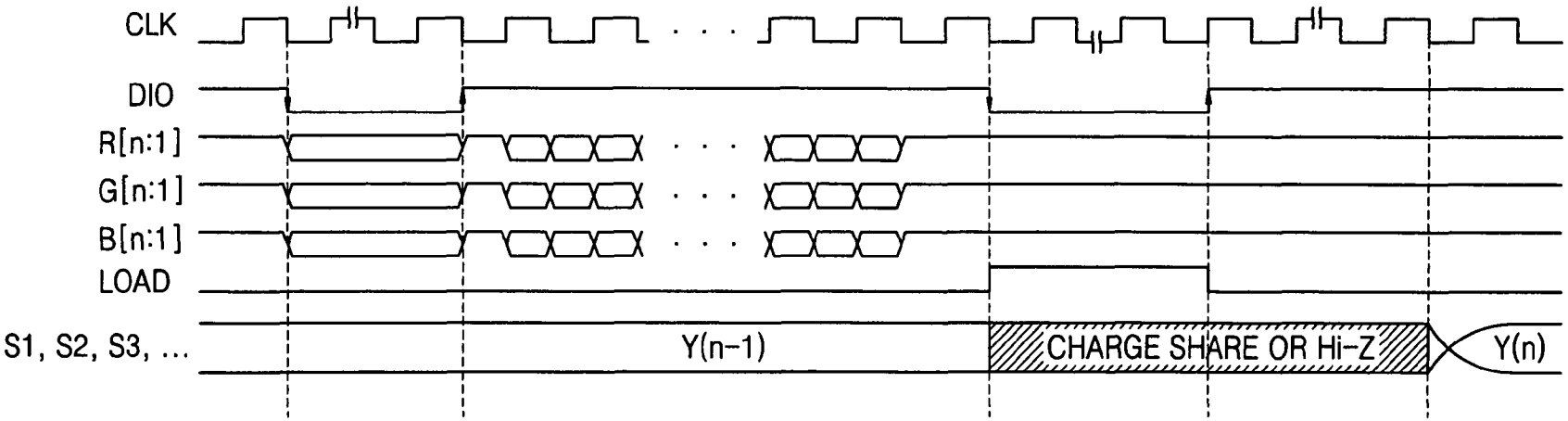
FIG. 5 is a timing diagram of signals such as channel output signals and a load control signal during operation of the source driver of FIG. 4, according to an embodiment of the present invention.

Referring to FIG. 5, after the data input/output control signal DIO transits from a logic low state to a logic high state, the latch circuit 411 latches the corresponding image data. The level shifter 412 changes the level of a signal output from the latch circuit 411 to a level suitable for the DAC 413 and outputs the level-changed signal as a digital signal to the DAC 413. The DAC 413 converts the digital output of the level shifter 412 into an analog gray voltage. The analog gray voltage generated by the DAC 413 is buffered by the buffer 414 and is output as a channel output signal for a corresponding channel.

As such, each channel output signal generated by a respective driving circuit 410 is output to a respective first switch 430. Each first switch 430 is opened or closed in response to a first channel state signal OUT. When a first switch 430 is closed, then that first switch 430 couples a respective analog gray voltage to a respective output channel and thus a respective source line for charging a pixel electrode of a display panel. When that first switch 430 is opened on the other hand, the respective analog gray voltage is not applied to any source line of the display panel.

Liquid crystal molecules of each pixel receiving an image signal from one of the driving circuits 410 are rearranged in proportion to the corresponding gray voltage, thus controlling the brightness of light emitted by the pixel. The input image data is data obtained by processing digital data of a three-color signal (that is, R (Red), G (Green), or B (Blue)) transmitted from a graphics card, etc. according to the resolution of the LCD panel in a controller (not shown).

The channel state signal generator 420 generates the first channel state signal OUT using state length data CSP and a load control signal LOAD. Referring to FIG. 5, the load control signal LOAD is activated to a logic high state during a part or the entirety of the time period when the data input/output control signal DIO is in the logic low state after being in the logic high state. A system clock signal CLK is used as a reference synchronization signal.

Conventionally, source lines of the display panel are in a high impedance state and a charge-share state during such a time period when the data input/output control signal DIO is set to such a logic low state. However, in embodiments of the present invention, a time period during which the first channel state signal OUT is activated to a logic low state is independently set according to the state length data CSP, regardless of an active period length of the load control signal LOAD.

The first channel state signal OUT is activated to the logic low state for a time period from when the load control signal LOAD is activated to the logic high state, in one embodiment of the present invention. Such a time period during which the first channel state signal OUT is activated is set according to the state length data CSP. When the first channel state signal OUT is activated, the plurality of first switches 430 are opened so that channel output signals generated by the driving circuits 410 are not output to the source lines of the display panel. That is, during this time, the output channels S1, S2, S3, and . . . of the source driver 400 are in a high impedance (Hi-z) state.

On the other hand, when the first channel state signal OUT is inactive, the plurality of first switches 430 are closed, and channel output signals Y(n) generated by the driving circuits 410 are coupled to the source lines through the closed first switches 430. In FIG. 5, Y(n−1) is a channel output signal for a previous scan line.

In order to couple the source lines to each other for charge sharing between the source lines while the output channels S1, S2, S3, and . . . are in the high impedance state, the source driver 400 further includes the plurality of second switches 440. The plurality of second switches 440 are controlled by a second channel state signal CS generated by the channel state signal generator 420. The plurality of second switches 440 are located between the output channels S1, S2, S3, . . . and are opened or closed in response to the second channel state signal CS. When the second switches 440 are closed, the source lines of the display panel are coupled together for charge sharing.

The second channel state signal CS is activated to a logic high state for a time period after the load control signal LOAD is activated. The time period during which the second channel state signal CS is activated is also determined by the state length data CSP. The plurality of second switches 440 are desired to be closed when the plurality of first switches 430 are opened. Thus, the second channel state signal CS is desired to be activated to the logic high state within the time period during which the first channel state signal OUT is activated to the logic low state. In this manner, the plurality of second switches 440 and the plurality of firs switches 430 are not closed simultaneously.

Referring to FIG. 5, a high impedance state and a charge-share state exists during each horizontal scan period, independent of the time period during which the load control signal LOAD is activated to the logic high state. Charge sharing between source lines of the display panel is desired for reducing power consumption and for high speed of charging pixel electrodes.

Figure 6:
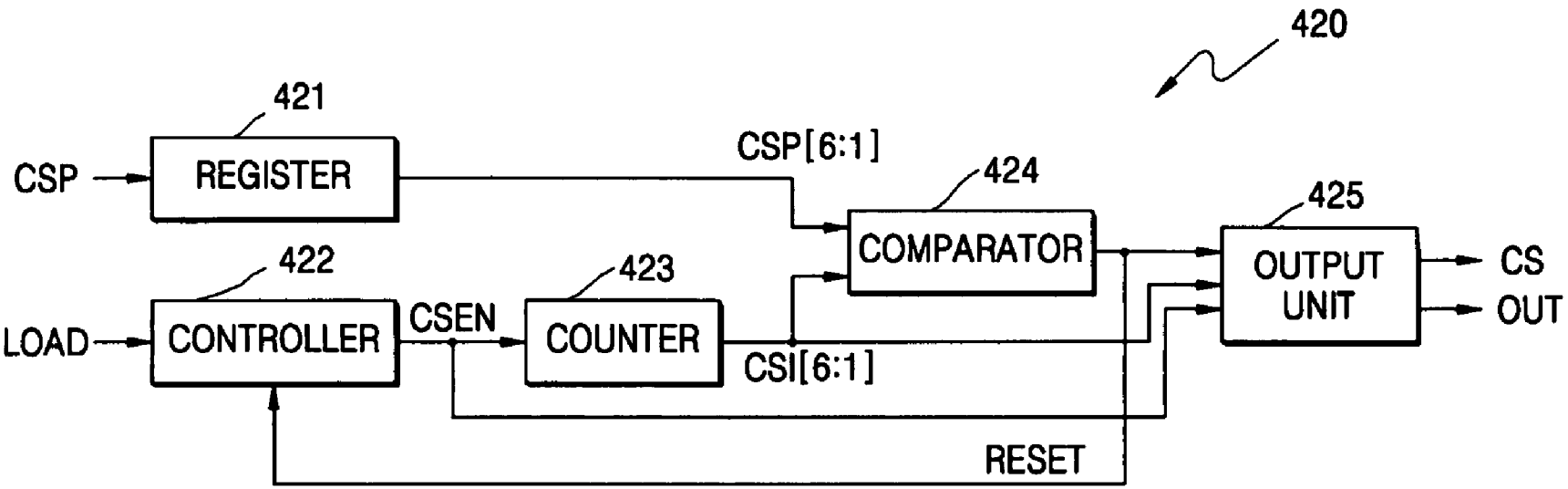
FIG. 6 is a block diagram of a channel state signal generator in the source driver of FIG. 4, according to an embodiment of the present invention.

FIG. 6 is a detailed block diagram of the channel state signal generator 420 of FIG. 4. Referring to FIG. 6, the channel state signal generator 420 includes a register 421, a controller 422, a counter 423, a comparator 424, and an output unit 425. The channel state signal generator 420 of FIG. 6 is described with reference to a timing diagram of FIG. 7.

The register 421 receives and stores the state length data CSP. The state length data CSP is used to set the time period during which the first channel state signal OUT is activated independently of the time period during which the load control signal LOAD is activated. The state length data CSP may include a plurality of data bits such as 6 bits for example in one embodiment of the present invention.

The state length data CSP is adjustable, and a user inputs the desired state length data into the register 421 through external hardware, in one embodiment of the present invention. Alternatively, the state length data CSP may be input by software into the register 421. For example, the register 421 receives the state length data CSP as part of the input image data. In this case, during a time period when image data is not latched by the driving circuits 410, the state length data CSP instead may be included and input to the register 421 as part of the image data.

Such a time period during which the input image data is not latched by the driving circuits 410 may be while the DIO signal is in a first initial logic low state, in FIG. 5. Alternatively such a time period during which the input image data is not latched by the driving circuits 410 may be a predetermined time period after the DIO signal has transitioned to a logic high state and after the latch circuits 411 have latched the image data.

In any case, a plurality of data bits of the state length data CSP may be input in parallel using at least two of the color input image data R, G, or B. In that case, the state length data CSP is input in parallel via at least two of the image data input terminals (labeled R, B, or B in FIG. 4). This method is effective when transmitting data in a cascade manner. Alternatively, the plurality of bits of the state length data CSP are serially input using one image data input terminal.

Figure 7:
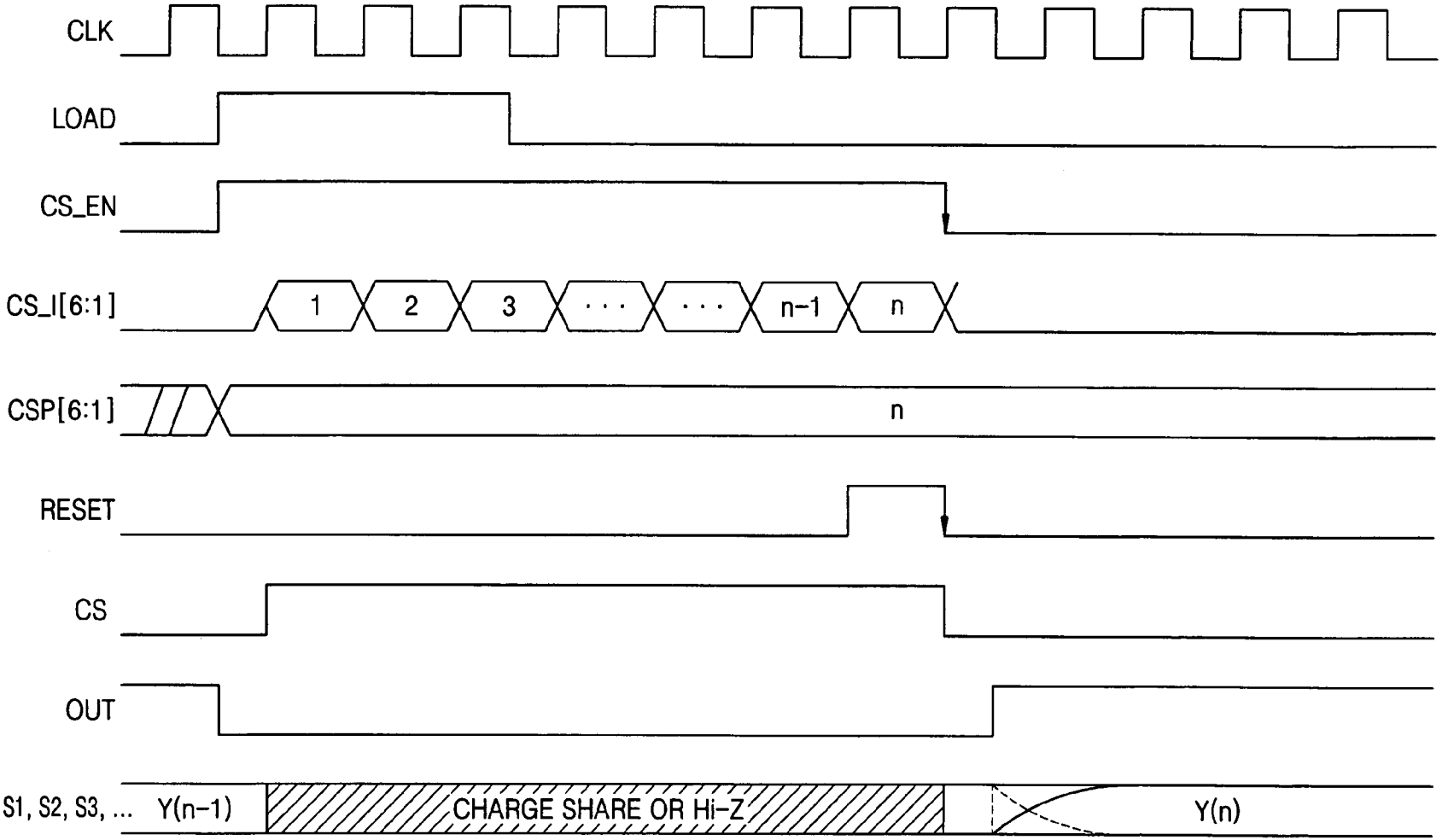
FIG. 7 is a timing diagram of signals such as the load control signal, a first channel state signal, and a second channel state signal during operation of the channel state signal generator of FIG. 6, according to an embodiment of the present invention.

Referring to FIGS. 6 and 7, the controller 422 generates an enable signal CSEN that is activated to the logic high state when the load control signal LOAD is activated to the logic high state. The enable signal CSEN becomes deactivated to the logic low state in response to a deactivation of a reset signal RESET. Here, the time period during which the load control signal LOAD is activated does not determine the time period during which the enable signal CSEN is activated.

The counter 423 is reset when the enable signal CSEN is activated to the logic high state. Thereafter, the counter 423 counts the number of cycles of the system clock signal CLK to generate count data CSI[6:1]. The count data CSI[6:1] is assumed to be 6 bits in one embodiment of the present invention, corresponding to the number of bits of the state length data CSP[6:1]. The comparator 424 compares the state length data CSP[6:1] with the count data CSI[6:1] to generate the reset signal RESET that is activated to the logic high state when the state length data CSP[6:1] and the count data CSI [6:1] are substantially equal.

The output unit 425 generates the first channel state signal OUT according to when the enable signal CSEN and the reset signal RESET are activated to the logic high state. The first channel state signal OUT is activated to the logic low state when the enable signal CSEN is activated to the logic high state. Thereafter, the first channel state signal OUT is maintained to be activated in the logic low state for a time period until after the reset signal RESET is deactivated to the logic low state.

As such, the time period during which the first channel state signal OUT is activated is determined according to the state length data CSP[6:1], independent of the time period during which the load control signal LOAD is activated. While the first channel state signal OUT is activated to the logic low state, a high impedance state is maintained so that the plurality of first switches 430 are opened for uncoupling the channel output signals from the source lines of the display panel.

For charge sharing between the source lines of the LCD panel during the high impedance state, the output unit 425 generates the second channel state signal CS depending on whether the count data CSI[6:1] has been enabled and whether the reset signal RESET has been activated. The second channel state signal CS is activated to the logic high state when the output CSI[6:1] of the counter 324 is enabled to reflect counting of the number of cycles of the CLK signal after the enable signal CS_EN has been activated to the logic high state. Subsequently, the second channel state signal CS is deactivated to the logic low state when the reset signal RESET transitions back to the logic low state from the logic high state.

Thus, the time period during which the second channel state signal CS is activated to the logic high state is set according to the state length data CSP, independent of the time period during which the load control signal LOAD is activated to the logic high state. In addition, note that the output unit 425 activates the second channel state signal CS to the logic high state within the time period when the first channel state signal OUT is activated to the logic low state. Thus, the second switches 440 are closed for charge sharing between the source lines of the display panel during a time period when the first switches 430 are opened to prevent coupling of gray voltages to the source lines. Thus, the first switches 430 and the second switches 440 are not closed simultaneously.

In this specification, the first switches 430 are N-type MOSFETs (Metal-Oxide-Semiconductor Field Effect Transistors). However, the present invention may also be practiced with the first switches 430 being P-type MOSFETs. In that case, the first channel state signal OUT would be activated to a logic high state to turn off the first switches 430 in the high impedance state. Thus, the example devices used and the logic high and low states as illustrated and described herein are by way of example only.

In this manner, the time period for charge sharing between the source lines is controlled independently of the load signal LOAD of the display device. The time period for such charge sharing is flexibly controlled by adjusting the state length data CSP that may be externally provided to the source driver by a user. Such flexibility is especially advantageous when the source driver is for large, high-resolution LCD panels.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, any number of elements shown and described herein is by way of example only.

What is claimed is:

1. A source driver of a display panel, comprising:

a channel state signal generator for generating a first channel state signal that is at a first logic state for a time period depending on an adjustable state length data that is comprised of multiple bits stored into a register; and a plurality of first switches that are opened for uncoupling channel output signals from source lines of the display panel when the first channel state signal is at the first logic state for charge share of the source lines, wherein the adjustable state length data is not a periodic signal used for generating the channel output signal, and wherein the adjustable state length data is not a periodic signal with pulses used for timing of said charge share, and wherein the time period during which the first channel state signal is at the first logic state is determined by the state length data, and is independent of time periods during which a load control signal is activated, and wherein said load control signal is activated during a part or an entirety of a blanking period when image data for determining said channel output signals is not latched by the source driver.

2. The source driver of claim 1, wherein the channel state signal generator generates a second channel state signal that is at a second logic state within the time period when the first channel state signal is at the first logic state.

3. The source driver of claim 2, further comprising:

a plurality of second switches that are closed for coupling together the source lines of the display panel when the second channel state signal is at the second logic state.

4. The source driver of claim 3, wherein the second switches are not closed simultaneously with the first switches being closed.

5. The source driver of claim 3, wherein the channel state signal generator includes:

a register for storing the state length data;

a counter for counting a number of cycles of a clock signal from when the load control signal is activated;

a comparator for activating a reset signal when the state length data and the counted number of cycles of the clock signal are substantially equal; and an output unit for generating the second channel state signal that is set to the second logic state after the counter begins counting the number of cycles of the clock signal and until an end of activating the reset signal.

6. The source driver of claim 5, wherein the output unit generates the first channel state signal that is set to the first logic state after the load control signal is activated and until after the end of activating the reset signal.

7. The source driver of claim 5, wherein the state length data is provided to the source driver from an external device independent of the load control signal.

8. The source driver of claim 1, further comprising:

a plurality of driving circuits for generating the channel output signals from color image data for the display panel.

9. The source driver of claim 8, wherein the state length data is input as part of at least one color image data during a time when the color image data is not latched by the driving circuits.

10. The source driver of claim 1, wherein the display panel is for a TFT-LCD (Thin Film Transistor-Liquid Crystal Display).

11. A source driver of a display panel, comprising:

means for generating a first channel state signal that is at a first logic state for a time period depending on an adjustable state length data that is comprised of multiple bits stored in a register; and means for uncoupling channel output signals from source lines of the display panel when the first channel state signal is at the first logic state for charge share of the source lines, wherein the adjustable state length data is not a periodic signal used for generating the channel output signal, and wherein the adjustable state length data is not a periodic signal with pulses used for timing of said charge share, and wherein the time period during which the first channel state signal is at the first logic state is determined by the state length data, and is independent of time periods during which a load control signal is activated, and wherein said load control signal is activated during a part or an entirety of a blanking period when image data for determining said channel output signals is not latched by the source driver.

12. The source driver of claim 11, further comprising:

means for setting the first channel state signal to the first logic state for said time period after activation of the load control signal for the display device.

13. The source driver of claim 12, further comprising:

means for inputting the state length data from an external device independent of the load control signal.

14. The source driver of claim 11, further comprising:

means for generating a second channel state signal that is at a second logic state within the time period when the first channel state signal is at the first logic state; and means for coupling together the source lines of the display panel when the second channel state signal is at the second logic state.

15. The source driver of claim 11, further comprising:

means for generating the channel output signals from image data for the display panel.

16. A method of driving a display panel, comprising:

inputting an adjustable state length data that is comprised of multiple bits and storing said multiple bits into a register;

generating a first channel state signal that is at a first logic state for a time period depending on the state length data; and uncoupling channel output signals from source lines of the display panel when the first channel state signal is at the first logic state for charge share of the source lines, wherein the adjustable state length data is not a periodic signal used for generating the channel output signal, and wherein the adjustable state length data is not a periodic signal with pulses used for timing of said charge share, wherein the time period during which the first channel state signal is at the first logic state is determined by the state length data, and is independent of time periods during which a load control signal is activated, and wherein said load control signal is activated during a part or an entirety of a blanking period when image data for determining said channel output signals is not latched by the source driver.

17. The method of claim 16, further comprising:

generating a second channel state signal that is at a second logic state within the time period when the first channel state signal is at the first logic state; and coupling together the source lines of the display panel when the second channel state signal is activated at the second logic state.

18. The method of claim 16, further comprising:

setting the first channel state signal to the first logic state after activation of the load control signal; and inputting the state length data from an external device independent of the load control signal.

19. The method of claim 16, further comprising:

generating the channel output signals from color image data for the display panel; and inputting the state length data as part of at least one color image data during a time when the color image data is not being latched for generating gray voltages.

20. The method of claim 16, wherein the display panel is for a TFT-LCD (Thin Film Transistor-Liquid Crystal Display).

* * * * *